United States Patent [19]

Estabrook

[11] 4,290,128

[45] Sep. 15, 1981

[54] TIME SEQUENCE MONITOR

[76] Inventor: Paul S. Estabrook, R.F.D. #1, East Kingston, N.H. 03827

[21] Appl. No.: 137,450

[22] Filed: Apr. 4, 1980

[51] Int. Cl.[3] ..... G04F 8/00

[52] U.S. Cl. ..... 368/1; 368/5; 368/6; 368/9; 368/10

[58] Field of Search ..... 235/92 T; 368/71, 5, 368/6, 8, 9, 10, 108, 110, 112, 107, 113, 46, 1

[56] References Cited

U.S. PATENT DOCUMENTS

| | | | |
|---|---|---|---|
| 3,508,034 | 4/1970 | Toyama et al. | 368/107 X |
| 3,854,281 | 12/1974 | Reichert | 368/9 |
| 3,965,669 | 6/1976 | Larson et al. | 368/9 |
| 4,188,825 | 2/1980 | Farrar | 368/1 X |

*Primary Examiner*—Ulysses Weldon

*Attorney, Agent, or Firm*—Thomas N. Tarrant

[57] ABSTRACT

Apparatus having a plurality of signal channels, a plurality of stopwatch circuits and a plurality of time lapse displays interconnected so that the relative time lapses in a series of related occurrences can be displayed.

8 Claims, 1 Drawing Figure

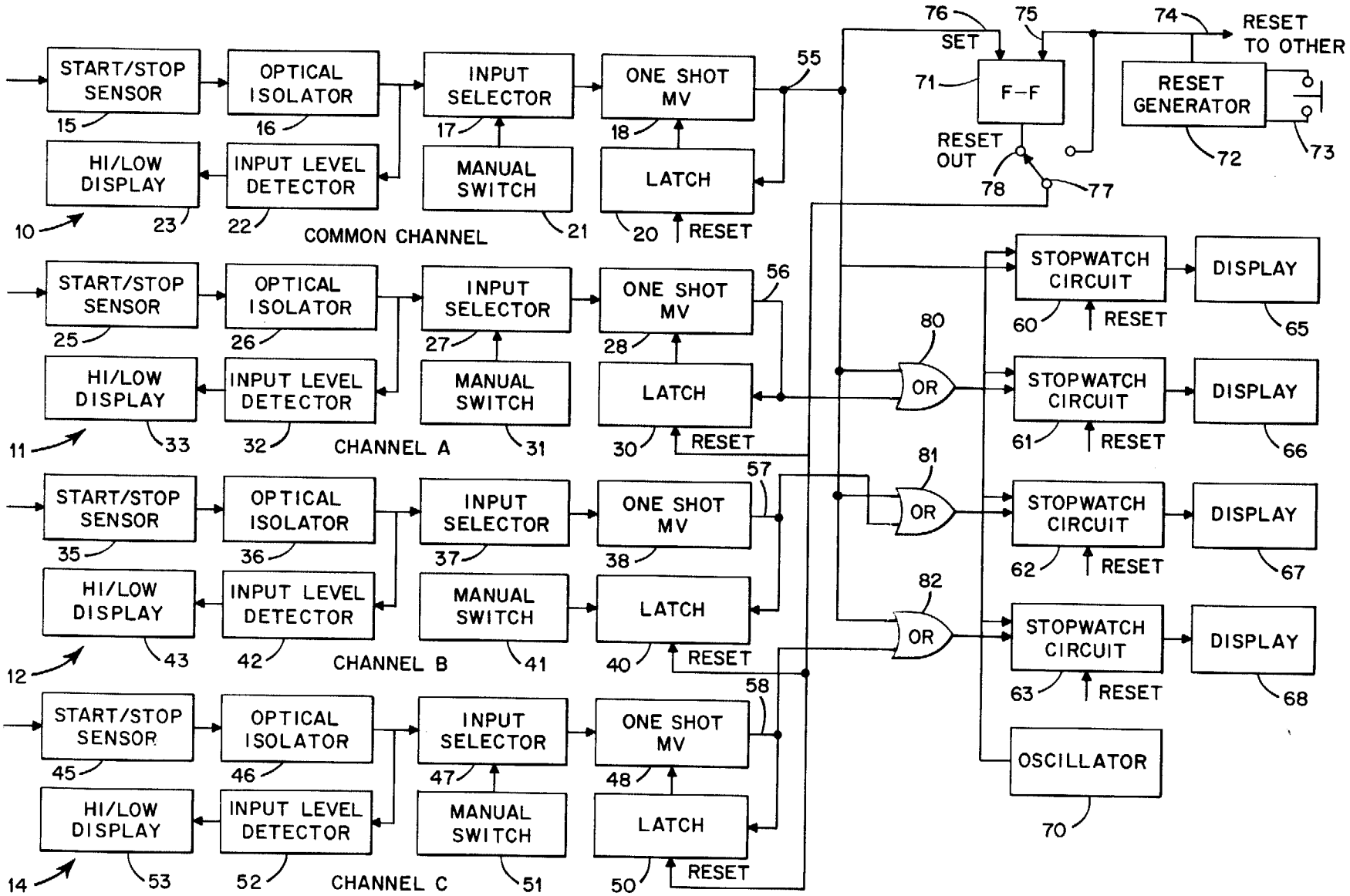
START/STOP SENSOR
OPTICAL ISOLATOR
INPUT SELECTOR
ONE SHOT MV
HI/LOW DISPLAY
INPUT LEVEL DETECTOR
MANUAL SWITCH
LATCH
RESET
COMMON CHANNEL
CHANNEL A
CHANNEL B
CHANNEL C
STOPWATCH CIRCUIT
DISPLAY
OR
OSCILLATOR
F-F
SET
RESET OUT
RESET GENERATOR
RESET TO OTHER

TIME SEQUENCE MONITOR

BACKGROUND OF THE INVENTION

1. Field of the Invention:

The present invention relates to electronic time monitoring equipment and in particular to such equipment that displays elapsed intervals between timed occurrences.

2. Description of the Prior Art:

Electronic stop watch circuits are known, operable for both start and stop functions by electrical pulses. It is also known to attach monitoring equipment to production machinery on the occurrence or lack of occurrence of predetermined events. Time monitoring equipment is also known and used to determine the rate of events such as the rate of production of manufactured items. There are also a number of specialized custom built monitors used for checking start up sequences of some types of complex equipment with connections to abort the sequence if a fault is detected.

SUMMARY OF THE INVENTION

Now according to the present invention, a time sequence monitor is provided operable responsive to many types of sequential operations to display individually the time intervals involved in the monitored sequence. A plurality of counting circuits are used, each connected to drive a respective display and each having a start/stop input connected to a signal channel operative to start and stop a respective count, one of the signal channels being connected to provide start/stop signals not only to its own counting circuits but to all the other counting circuits in common. Thus it is an object of the invention to provide a time sequence monitor which will display the time intervals for each of a sequence of functions.

Further objects and features of the invention will become apparent upon reading the following description together with the drawing.

BRIEF DESCRIPTION OF THE DRAWING

A block diagram of a time sequence monitor according to the invention.

DESCRIPTION OF THE PREFERRED EMBODIMENT

The invention uses a series of signal channels each one able to detect the occurrence of an event in a sequence of events and operate a stop watch circuit. As depicted in the drawing, one of the signal channels 10 is desirably a common channel which can be used to operate all stopwatch circuits. Three additional signal channels, 11, 12, and 14 are depicted each connected to operate a respective stopwatch circuit. Each of signal channels 10, 11, 12 and 14 begins with a start/stop sensor 15, 25, 35, and 45 respectively. In their simplest form, the start/stop sensors 15, 25, 35 and 45 merely detect the operation of an electrical switch or relay. They may also use photo detectors to detect a mechanical movement or other types of sensors to detect an occurrence.

Start/stop sensor 15 of common channel 10 will normally be connected to sense the operation of the main switch, which acts at the commencement of a start up sequence. All the signal channels are suitably identical and common channel 10 can be taken as exemplary. In common channel 10, start/stop sensor 15 is connected to an optical isolator 16. Optical isolator 16 suitably uses optoelectronics to detect a voltage signal from sensor 15 and provide an isolated output pulse to input selector 17. Input selector 17 is connected to provide an input pulse to one shot multivibrator 18. The purpose of input selector 17 is to determine whether a high level or a low level signal from optical isolator 16 will be recognized for providing an input to multivibrator 18. One shot multivibrator 18 has an output connection 55 which is connected to latch 20. Latch 20 is a latching circuit that operates on receipt of a signal to block one shot multivibrator 18 and prevent further action.

The signal channels as depicted are designed to be operated by voltage level changes of usual data processing systems as well as other types of signals. Thus optical isolator 16 in response to an input voltage change, which could be 115 volts AC from a power switch or 5 volts DC from a data processing system, will put out a voltage suitably 5 volts DC. In either case however, it is desired that multivibrator 18 operate in response to a voltage transition in a given direction. The given direction could be a transition for example from plus 5 volts to 0 volts or it could be the reverse direction, 0 to plus 5 volts. Thus the output of optical isolator 16 is connected to input level detector 22 which detects the output level of optical isolator 16 and displays it on high/low display 23 connected to detector 22. Display 23 is suitably 2 light emitting diodes, one of which will be illuminated to show a high level output and the other to show a low level output. Input selector 17 can then be preset by manual switch 21 to respond to a voltage change in a predetermined direction. As an example, input selector 17 could be a one shot with an inverting and a noninverting input. Switch 21 could then enable the selected input and disenable the other one. It will be seen that, if in the rest condition display 23 is showing a high level and switch 21 is set so that selector 17 will respond to a low to high level change, then there will be no response to the next transition from isolator 16, which will necessarily be a high to low transition. The response will only come on the following low to high transition. But assuming that it is desired to respond to a condition where a voltage is sensed by sensor 15 with no voltage in the rest state, then the rest condition should show a low output from isolator 16 and selector 17 would be set to respond to a low to high level transition. That would then be the first transition occurring and would be connected through to operate multivibrator 18. Output 55 of multivibrator 18 is connected to start/stop input of stopwatch circuit 60.

A number of integrated circuits are available on the market suitable for use as stopwatch circuit 60. One example is stopwatch circuit ICM 7205 available from Intersil Inc. 10900 North Tantau Ave., Cupertino, Calif. Output 55 is also connected to OR gates 80, 81 and 82. Additional channels maybe used beyond those depicted in the drawing. Output 55 is suitably connected to OR gates for each channel. The output of OR gates 80, 81 and 82 are connected to the start/stop inputs of stopwatch circuits 61, 62 and 63 respectively. Stopwatch circuits 60, 61, 62 and 63 each have display drive outputs connected to displays 65, 66, 67 and 68 respectively. Displays 65, 66, 67 and 68 can be LED displays, however other types of displays such as video or printing displays are also contemplated. Output 56 from signal channel 11 is connected to a second input of OR gate 80. Input 57 of signal channel 12 is connected to a second input of gate 81 and output 58 from signal channel 14 is connected to a second input of OR gate 82. Precision timing oscillator 70 is connected to an oscillator input of each of stopwatch circuits 60, 61, 62 and 63. While usual stopwatch circuits all contain oscillators, the essential timing precision is usually obtained by connecting a crystal and other timing components exterior to the integrated stopwatch circuit. The cost of the individual crystals and other components is avoided by using a common oscillator. This arrangement also provides synchronization between the circuits. While oscillator 70 is depicted independently, it should be understood that it can be an oscillator integrated in one of the stopwatch circuits connected with a suitable crystal and interconnected to the other stopwatch circuits.

Reset terminal 74 of reset generator 72 is connected to a reset input of each stopwatch circuit 60, 61, 62 and 63. Reset terminal 74 is also connected to reset input 75 of flip-flop 71 and to the reset input of latch 20. Reset generator 72 has manual switch 73 operable to provide a reset pulse from generator 72. Flip-flop 71 has set input 76 connected to output terminal 55 of multivibrator 18. Reset output 78 of flip-flop 71 is connected to a terminal of switch 77 which in turn is connected to the reset inputs of each of latches 30, 40, and 50.

In operation, the monitor is usually started by operating switch 73 so that a pulse from reset generator 72 resets all the stopwatch circuits including their displays, flip-flop 71 and latch 20. The reset input to flip-flop 71 does not provide a reset output on terminal 78. The reset output on terminal 78 is not provided until flip-flop 71 is set by a pulse at terminal 76 following a reset pulse at terminal 75. Thus all the multivibrators 28, 38, and 48 are disenabled at this time. The desired input is sensed by input 15. A pulse is provided at output terminal 55 which starts all the stopwatch circuits so that all displays 65, 66, 67 and 68 start counting. This same output at terminal 55 disenables further outputs from multivibrator 18 through action of latch 20 and sets flip-flop 71 providing a reset pulse to latches 30, 40 and 50 enabling the other signal channels as the selected signals appear at each of sensors 25, 35, and 45. Outputs at terminals 56, 57 and 58 stop circuits 61, 62, and 63 and their respective displays.

The time sequence monitor according to the invention is subject to a large number of variations. By operation of switch 77 to connect the reset inputs of channels 11, 12, and 14 directly to reset output 75, all channels are reset simultaneously. This would allow monitoring for a condition in which one of channels 11, 12 and 14 receives an input signal prior to the common channel. Output from the common channel would then stop the stopwatch circuit that had been activated by the individual channel output. The display would indicate how long before the common channel signal the individual channel occurrence had happened. Another variation would connect the last of the individual signal channels as an OR'D reset input to latch 20. This would allow a further output for multivibrator 18 which would stop circuit 60 but would or would not restart the other stopwatch circuits depending upon whether the circuits were connected to respond to a further input without a reset or not. A still further variation connects the output of the last individual channel to reset generator 72 for enabling a new sequence. This could be desirable in continuous monitor of cyclical events.

Thus while the invention has been described with respect to a specific embodiment, it will be seen that a number of variations are contemplated as obvious to those skilled in the art and it is the intention to cover the invention within the scope of the following claims.

I claim:

1. A time sequence monitor for displaying the time elapses for a sequence of functional occurrences comprising:

(a) a plurality of stopwatch circuits each having a start/stop connection and a display output connection.

(b) a plurality of display means each connected to a respective one of said stopwatch circuits to display time intervals counted thereby;

(c) a plurality of signal channels each of which comprises:

(1) a signal sensor for detecting one of said occurrences;

(2) pulse means connected to said sensor for providing an electrical pulse responsive to said sensor;

(3) latch means connected to said pulse means for latching said pulse means responsive to a pulse output of said pulse means and inhibiting further pulses; and, (4) reset means connected to said latch means for resetting said latch to reenable said pulse means;

(d) a common connection of the pulse means of one of said signal channels to the start/stop input connection of each of said stopwatch circuits; and (e) an individual connection from the pulse means of each of the remainder of said signal channels to one of the start/stop inputs of a respective one of said stopwatch circuits whereby all of said stopwatch circuits can be started or stopped by one common signal channel and said stopwatch circuit can be individually started or stopped by a respective signal channel.

2. A time sequence monitor according to claim 1 further comprising a common oscillator connected to each of said stopwatch circuits as a time base.

3. A time sequence monitor according to claim 1 wherein each of said signal channels includes an optical isolator for accepting a large range of input signals and providing a predetermined electrical output signal electrically isolated from the input signal.

4. A time sequence monitor according to claim 1 wherein the reset means for each of said signal channels except said one of said signal channels is connected to a reset circuit driven by the pulse means of said one of said signal channels whereby said remainder of said signal channels is inoperative until a pulse has been provided by said one of said signal channels.

5. A time sequence monitor according to claim 1 wherein each of said circuit channels further comprises an input level detector and an input selector said input level detector connected to said signal sensor to detect the input level and said input selector connected between said signal sensor and said pulse means to select the direction of input signal level change that will be operable to drive said pulse means.

6. A time sequence monitor according to claim 5 wherein said input level detector is connected to drive an illuminating display for indicating whether an input signal is of a high or low level.

7. A time sequence monitor according to claim 1 further comprising a master reset generator and an individual channel latch reset circuit, said latch reset circuit being responsive to said reset generator to provide a first condition said reset circuit being connected to the pulse means of said one of said signal channels and responsive to output of said pulse means of said one of said signal channels to switch to a second condition where upon a reset pulse is provided by said reset circuit to reset the latch in each of said remainder of said signal channels.

8. A time sequence monitor according to claim 7 wherein the output of said reset circuit is connected to a switch which in turn is connected to the reset input of the latch in each of said remainder of said signal channels and said switch has a second position which connects the reset input of each latch of the remainder of said signal channels directly to said master reset generator, whereby the remainder of said signal channels can be enabled only after an output of said one of said signal channels or by operation of said switch can be enabled simultaneously with enabling of said one of said signal channels.

* * * * *